United States Patent [19]

Schiavo et al.

[11] Patent Number: 4,729,751

[45] Date of Patent: Mar. 8, 1988

[54] DOLL WITH ATTACHMENT MEANS

[76] Inventors: Cynthia G. Schiavo, 3702 Deerford; Carol P. Faller, 5138 Verdura Ave., both of Lakewood, Calif. 90712

[21] Appl. No.: 895,223

[22] Filed: Aug. 11, 1986

[51] Int. Cl.[4] ..... A63H 3/00

[52] U.S. Cl. ..... 446/268; 446/901

[58] Field of Search ..... 446/268, 146, 390, 321, 446/369, 901

[56] References Cited

U.S. PATENT DOCUMENTS

| | | | |
|---|---|---|---|
| 3,789,547 | 2/1974 | Chemarin | 446/390 X |
| 4,197,670 | 4/1980 | Cox | 446/369 |
| 4,373,292 | 2/1983 | Pelura | 446/268 |

FOREIGN PATENT DOCUMENTS

| | | | |
|---|---|---|---|
| 2013508 | 8/1979 | United Kingdom | 446/321 |

*Primary Examiner*—Philip C. Kannan

*Attorney, Agent, or Firm*—Don A. Hollingsworth

[57] ABSTRACT

A doll with fastening means attached to its hands and back to enable the doll to hold objects or to hold on to a mating fastening means attached to another doll. Dolls of the prior art that are capable of holding objects usually have hands that are shaped to hold a rounded object or a rounded portion of an object between the thumb and index finger by means of a resilient clamping action between the thumb and index fingers or by merely creating an interference fit with the object to be held. This type of construction is severely limiting as to the types of objects the doll can grasp and hold onto, and with age and wear, the dolls hand members attain a permanently stretched apart condition after which the ability to hold objects is greatly diminished or entirely lost. The doll constructed according to the invention has a doll body including a head, a torso poriton, a pair of arms with hands, and a pair of legs with feet, as well as doll clothing. A fastening means is attached to the outer surface of at least one of the hands of the doll, preferably both. Another fastening means is centrally attached to the outer surface of the clothing covering the rear upper torso portion of the doll. In this fashion, the fastening means of a pair of dolls cooperate for a mutually engaging and capturing one another in a holding position in which an arm and hand of one doll is held with its arm around the back of the other doll. The two hands of a doll may also be releasably held together, in an alternate embodiment of the invention.

9 Claims, 4 Drawing Figures

DOLL WITH ATTACHMENT MEANS

BACKGROUND OF THE INVENTION

1. Field of Art

This invention relates to a doll, and more particularly to a doll with fastening means attached to its hands to enable the doll to hold objects or to hold onto a mating fastening means attached to another doll or object.

2. Summary of the Prior Art

Dolls that are capable of holding objects are notoriously well known. Such dolls usually have hands that are shaped to hold a rounded object or a rounded portion of an object between the thumb and index fingers by means of a resilient clamping action between the thumb and index finger or by merely creating an interference fit with the object to be held.

While such a doll construction can provide hours of fun and enjoyment for a child, this type of construction is severely limiting as to the types of objects the doll can grasp and hold onto, and with age and wear, the dolls hand members attain a permanently stretched apart condition, after which the ability to hold objects is greatly diminished or entirely lost.

Moreover, with the dolls of the prior art just described, it is typically not possible to have the doll's hand removably attached or fastened to any portion of another doll. Generally, any object to be held in the doll's hand must be cylindrically shaped and rather slender at that, and finding such a geometrical shape on the clothing of another doll, or placing such an object on the clothing of another doll, would constitute extremely remote possibilities.

There is a refreshing trend these days to teach children the values of friendship and cooperation between people of all ages, races, and religions. However, other than merely designing "look alike" dolls that have features that suggest different races, the doll manufacturing industry has utterly failed in being able to communicate and teach such ideals to young children through the use of dolls in a "pretend" world.

Accordingly, there is a need in the art of doll manufacturing to produce a doll which has the ability to hold objects by its hands reliably, firmly, and lastingly. Furthermore, there is a clear need for an introduction into the doll world of dolls that can simulate the kind of friendship as demonstrated, for example, in the recent "Hands Across America" program. The 1984 Olympics, the "Hands Across America" program, and the 1986 "Goodwill Games" are leading examples of the teaching of worldwide friendship values, and these values can be instilled in young children with little or no "teaching" effort on behalf of us adults as parents, if the values of morality and friendship are experienced directly by the children in their daily playing with their toys. A doll which can hold its arm around another doll, and in fact, a number of dolls lined up in a row each with it's arm around it's neighbor on either side, would be an extremely valuable teaching tool for the very young. The present invention satisfies all of these apparent needs of the art of doll manufacturing.

BRIEF SUMMARY OF THE INVENTION

The doll construction and arrangement according to the invention has a doll body including a head, a torso portion, a pair of arms with hands, and a pair of legs with feet, as well as doll clothing. The improvement over the prior art is found in the provision of a novel attachment means or fastening patch attached to the outer surface of at least one of the hands of the doll and positioned on the hand so as to be easily accessible. Another fastening patch is centrally attached to the outer surface of the clothing covering the rear upper torso portion of the doll and is also positioned to be easily accessible. In this fashion, the fastening patch attached to one of the doll's hands and the fastening patch attached to the back of another similar doll cooperate for a mutually engaging and capturing one another in a holding position in which an arm and hand of one doll is held around the back of the other doll.

Mating fastening patches can also be attached to certain objects, so that the fastening patch on such objects can be fastened with and held and captured with the doll's hand.

In a preferred embodiment of the invention, the doll will be provided with fastening patches on both hands. In this manner, the hand of a doll can be removably attached to the central rear torso portion of another doll, and the hand with fastening patch of such other doll can likewise be attached to the central rear torso portion of the first-mentioned doll.

In order to permit flexibility in the usage of the doll's fastening patches in the attaching of such fastening patches to objects and other dolls, the fastening means are constructed in two forms, referred to herein as male and female forms, and the reasoning for the distinguishing of the two types will become evident in the detailed description of the preferred embodiments.

BRIEF DESCRIPTION OF THE DRAWINGS

The invention will now be described in detail having reference drawing in which.

DETAILED DESCRIPTION OF THE PREFERRED EMBODIMENTS

Figure 1:
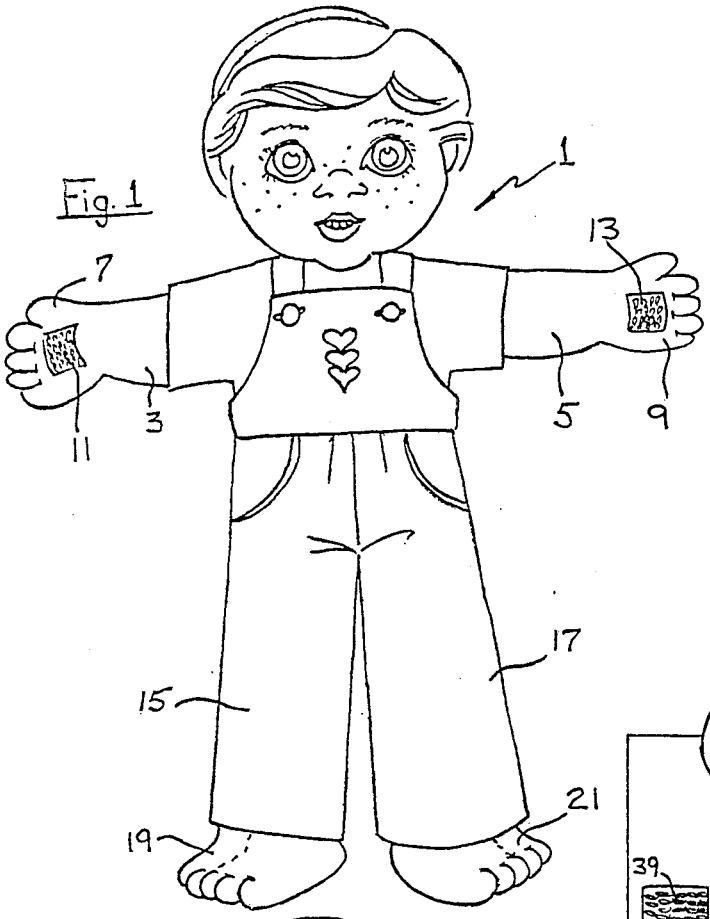
FIG. 1 is a front view of a doll showing the positioning of the hand fastening means in accordance with the invention.

In FIG. 1, the front view of a doll made in accordance with the invention is illustrated. The doll 1 comprises a pair of arms 3, 5 and associated hands 7, 9, each hand shown to have attached thereto one of a pair of fastening patches 11, 13, respectively. The doll is complete with legs 15, 17 and associated feet 19, 21.

Figure 2:
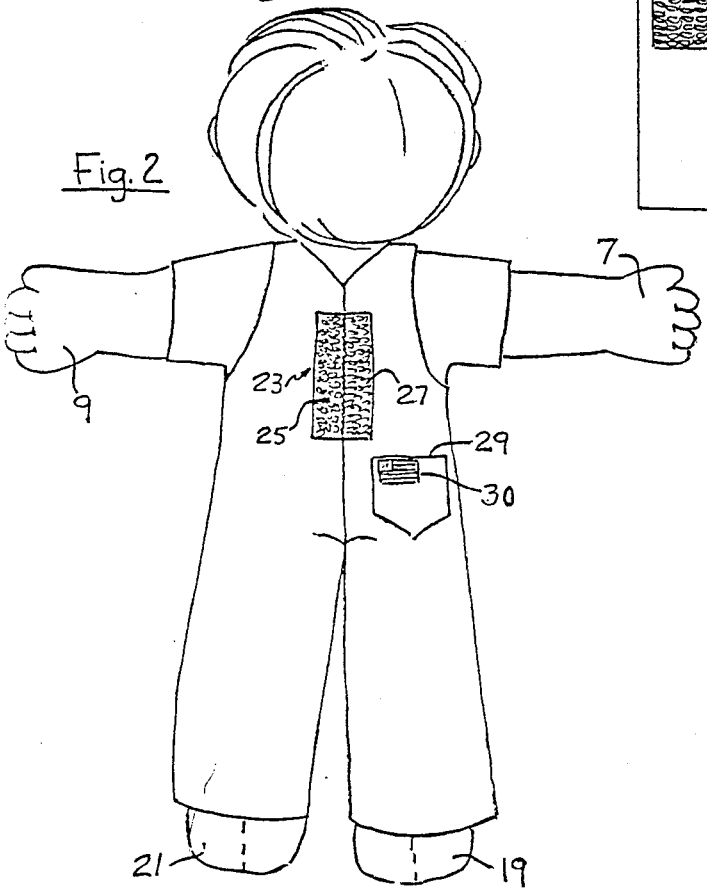
FIG. 2 shows a rear view of the doll illustrating the position of the fastening means located in the central rear torso portion of the doll.

In the illustration of FIG. 2, the rear view of the doll shows a fastening patch 23 comprised, preferably, of two vertical strips 25 and 27. A hip pocket 29 with a flag emblem 30 attached can also be seen in the rear view of FIG. 2.

Referring now to the two views of FIGS. 1 and 2, the fastening patch 11 is attached to the outer surface of hand 7, facing inwardly (in the direction the doll is facing), and is seen to be positioned so as to be easily accessible. The fastening strip 23 is shown to be centrally attached to the outer surface of the clothing covering the rear upper torso portion of the doll, and it also is clearly positioned to be easily accessible.

Under these placement conditions, it can be readily appreciated that, assuming the doll of FIG. 1 is a different doll from that of FIG. 2 but identically constructed, the fastening patch 11 of the doll of FIG. 1 and the fastening strip 23 of the similar doll of FIG. 2 cooperate for mutually engaging and capturing one another in a holding position in which the arm and hand of the doll of FIG. 1 is held with its arm around the back of the doll of FIG. 2.

Dimensionally, in order for the hands 7, 9 of a pair of dolls to mutually engage the attachment strip 23 on the back of the other doll, and defining the torso portion of the doll to have a width W at the location at which the arms 3, 5 attach, the fastening patches 11, 13 are attached at a location along the hand 7, 9 approximately the distance W from the fastening patch 23 of the same doll, measured along a line running through the torso of the doll and axially along the outwardly extended hand as shown in FIGS. 1 and 2.

While a variety of fastening means may be chosen to implement the doll construction, such as male/female metal snaps, button/hole combinations, sticky surfaced patches, and the like, it is proposed, according to the present invention, to use what is generically referred to as "hook and loop" material and what is more specifically referred to as Velcro, a registered trademark. Except for the "sticky" surface type of fastening means, all of the aforementioned fastener types incorporate male and female elements which cooperate to releasably hold the members to which they are attached in juxtaposition. In the following description, the "hook and loop" example will be used for illustration purposes only, and it is to be understood that any other type of fastener which accomplishes the same results can be used without altering the nature of the invention. In the "hook and loop" example, the hook material may be referred to as male Velcro, while the loop material may be referred to as female Velcro.

Unlike the aforementioned clamping action of prior art dolls that deteriorates with age, the holding or fastening action of Velcro patches retains its holding power substantially indefinitely.

Figure 3:
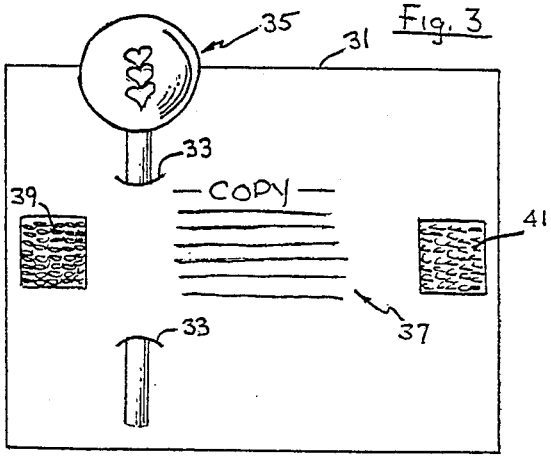
FIG. 3 shows an object which may be typical of the type of objects that the doll according to the invention can releasably, but reliably hold.

A preferred object which the doll is designed to hold in its hands is shown in FIG. 3 as a card-like item card 31 having a pair of die cut slots 33 adapted to hold the barrel of a writing utensil 35. In use, and in its packing carton, the doll will hold card 31 so as to permit an area of indicia 37 to be viewed by the purchaser or user. Velcro material patches 39 and 41 are placed near the outer edges of the card 31 so as to be able to be held by the hands of the doll and yet allow the indicia region 37 to be exposed.

Since the card 31 has a pair of attachment or fastening patches 39, 41, the doll of FIG. 1 is shown to have a pair of fastening patches 11, 13. The doll's arms 3, 5 are designed to pivot around the point of connection with the torso, and the arms and hands are bendable so as to loop around in order that the fingers of the hands 7 and 9 are pointed toward each other and fastening patch 11 attaches to fastening patch 39, while fastening patch 13 attaches to fastening patch 41, again permitting the doll to hold the card 31 securely and allow the indicia 37 to be seen between the fingertips of the two hands 7, 9.

With the arrangements described heretofore, the patches 11, 13 may be made of male Velcro, while the patches 23, 39, and 41 can be made of female Velcro. However, this would not permit the hands of a single doll to be brought together in a prayerful position. In order to accommodate this desirable feature of the doll, a preferred embodiment of the invention requires one of the patches 11, 13 to be male and the other to be female. In the remainder of the description, the exemplary arrangement of male Velcro for the patch 11 and female Velcro for the patch 13 will be used.

Since the patches 11 and 13 are of different male/female configurations, it is not possible to have a common male/female configuration for the entire patch 23 on the rear of the doll. Accordingly, patch 23 is comprised of a pair of vertically oriented strips 25, 27, strip 25 mating with strip 11 and therefore being made of female Velcro, while, for similar reasons, vertical strip 27 is of male Velcro.

In this second embodiment having different materials for patches 11 and 13, correspondingly different patches will be required for patches 39, 41, where patch 39 would be female and patch 41 would be male.

In the case where at least three dolls are joined with their arms around each other in a row, the central doll would have a pair of hands attached to the strip 23 on its back, one hand from the doll on each side. Accordingly, in order to accommodate this arrangement conveniently and effectively, the fastening strip 23, and, of course, its constituent elongated strips 25, 27, are of a vertically extending length sufficient to accommodate the width of a pair of doll hands.

Figure 4:
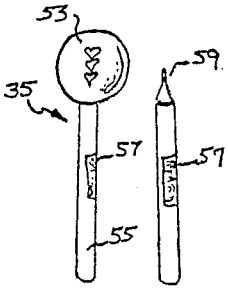
FIG. 4 shows a pen with fastening patch enabling the doll to engage and capture the object, which object makes up a portion of the object shown in FIG. 3.

FIG. 4 shows the pen 35 of FIG. 3 in more detail. The pen 35 is comprised of a pen barrel 55 and pen cap 53. A Velcro patch 57 is attached to the barrel 55, the patch 57 being constructed of either loop or hook material depending upon whether the pencil is to be carried in the right or left hand 3, 5, respectively. The rightmost drawing of FIG. 4 merely shows a typical ball point pen tip 59 which, in the covered position shown in the leftmost drawing is closed with the large rounded safety cap 53.

Because of the "friendship" character of such dolls made in accordance with the invention, it is advantageous to manufacture the dolls with a variety of racial groups represented. Accordingly, it is an object of the invention to design the clothes of the doll to be somewhat standard for all dolls and to design the head to be of a standard size and shape from doll to doll, yet provide coloring agents and painted facial features that simulate children of any one of yellow, brown, red, black, or white skinned races. The processes by which the plastic skin of the doll can be colored and painted are notoriously well known and need not be explained in this description. On the other hand, it is a feature of the invention that, while the molded shape of every doll head is identical, the color of the skin, painted features, and hair are different so as to depict the various races enumerated above.

Continuing in the education and appreciation of the small child in international 'friendship' relations, as another teaching tool, it is preferred that the dolls be provided with clothing that includes a rear hip pocket accommodating a flag emblem of the country represented by the facial features of each individual doll.

It can be appreciated that an improvement in dolls has been described in which each doll's hands can individually be clasped together in a prayerful position, while permitting each doll to alternately have its arm or arms around the back and attached to the back of an adjacent doll or adjacent dolls. It is clear that modifications of the doll as described and shown in the foregoing might be made without affecting the scope and spirit of the invention. For example, Velcro patches could also be attached to the toes or hips of the doll so that the arms could be attached thereto, thereby simulating the doll going through a series of aerobics or exercises, all in the interest of teaching the child the importance of being physically fit. Accordingly, it is to be understood that the invention is not to be limited by the specific embodiments described herein but is to be limited only by the scope of the attached claims.

We claim:

1. In a doll having a doll body including a head, a torso portion, a pair of arms with hands, a pair of legs with feet, and doll clothing, the improvement comprising:

fastening means solely of hook material attached to the palm of one hand and positioned to be easily accessible;

fastening means solely of loop material attached to the palm of the other hand and positioned to be easily accessible;

fastening means comprising a material having both hooks and loops centrally attached to the otuer surface of the clothing covering the rear upper torso portion and positioned to be easily accessible;

said hand fastening means of said doll and said torso fastening measns of another, similar, doll cooperating for mutually engaging and capturing one another in a holding position in which an arm and hand of said one doll is held with its arm around the back of said other doll, thereby enabling a row of dolls to have alternately engaging fastening means and, consequently, every doll to have its arms held around the backs of its adjacent doll or dolls;

said torso portion having a width W at the location of the attachment of said arms; and said hand fastening means being attached at a location along said hand approximately the distance W from said torso fastening means.

2. The doll as claimed in claim 1, wherein said torso fsatening means is vertically extended along said upper torso portion of a length sufficient to accommodate the hands of a doll on each side thereof.

3. The doll as claimed in claim 1, wherein said torso fastening means comprises:

a first vertical length of hook material; and a second vetical length of loop material adjacent said first vertical length of hook mateiral; and wherein:

the vertical length of loop material is on the same side of said doll as said loop material on the hand of the same side; and the vertical length of hook material is on the same side of said doll as said hook material on the hand of the same side;

thereby permitting the hand with loop material to readily fasten with hook material on the back of an adjacent doll, and likewise permitting the hand with hook material to readily fasten with loop material on the back of an adjacent doll.

4. The doll as claimed in claim 1 in combination with a writing utensil, wherein said writing utensil has a fastening means attached means attached to its barrel and is fastenable with said fastening measn attached to one of said hands.

5. The doll claimed in claim 1, wherein said first fastening means is attached to the inner-facing or palm side of said hand.

6. The doll as claimed in claim 1, wherein:

said doll head is designed to be of standard size and shape doll-to-doll, yet comprising coloring agents and painted facial features that simulate children of any one of yellow, brown, red, black, or white skinned races; and doll's clothing includes a rear, hip pocket accommodating a flag emblem of the country represented by said facial features.

7. The doll as claimed in claim 1, in combination with a writing utenisil, wherein said writing utensil has a barrel with a fastening means attached thereto, and wherein said barrel fastening measn is selected to be of loop material when said writing utensil is to be held by one of said doll hands, and is selected to be of hook material when said writing utensil is to be held by the other of said doll hands.

8. The doll as claimed in claim 1, in combination with a card-like item having indicia thereon, said card-like item having first and second fastening means attached near its lateral edges, said first and second fastening means matingly engageable with corresponding ones of said fastening means on the hands of said doll, one of said first and second fastening means being of loop material and the other of hook material;

thereby permitting said doll to simulate the holding of the card in the dolls two hands to display said indicia in front of the doll's torso.

9. The doll as claimed in claim 8 in combination with a writing utensil having a barrel portion and a writing portion, wherein said card-like item has means defining a pair of laterally extending and vertically spaced die cut slots, said barrel portion being slideable in one slot and out the other to thereby be fixedly captured in said card-like item and dispalyable on the same surface of said card containing said card fastening means.

* * * * *